United States Patent [19]

Buchtel

[11] Patent Number: 4,575,939

[45] Date of Patent: Mar. 18, 1986

[54] CUTLERY STORAGE APPARATUS

[76] Inventor: Michael E. Buchtel, 2467 Norse Ave., Costa Mesa, Calif. 92627

[21] Appl. No.: 628,620

[22] Filed: Jul. 6, 1984

[51] Int. Cl.[4] ..... A47F 5/16

[52] U.S. Cl. ..... 30/296 A; 211/60.1; 248/37.3

[58] Field of Search ..... 30/296 A, 296 R; 211/70.6, 70.7, 60.1; 269/254 R; 412/33, 34, 900; 248/37.3

[56] References Cited

U.S. PATENT DOCUMENTS

| | | | |
|---|---|---|---|
| 2,899,077 | 8/1959 | Timms | 211/70.6 |
| 3,176,504 | 4/1965 | Shapiro | 211/60.1 |
| 3,305,100 | 2/1967 | Barbee | 211/70.6 |
| 3,980,608 | 9/1976 | Faltersack | 248/37.3 |
| 4,310,094 | 1/1982 | Hotchkiss | 211/70.6 |
| 4,351,546 | 9/1982 | Cognata | 412/34 |

*Primary Examiner*—Jimmy C. Peters

*Attorney, Agent, or Firm*—Knobbe, Martens, Olson & Bear

[57] ABSTRACT

A knife holder comprising a plurality of paper sheets placed in side by side relation so that knife blades may be received and gripped between the sheets. A compression force is applied to the outermost sheets close to the entry edge of the sheets so that even short blades will be gripped and such that each sheet along the entry edge flares outward to facilitate insertion.

9 Claims, 8 Drawing Figures

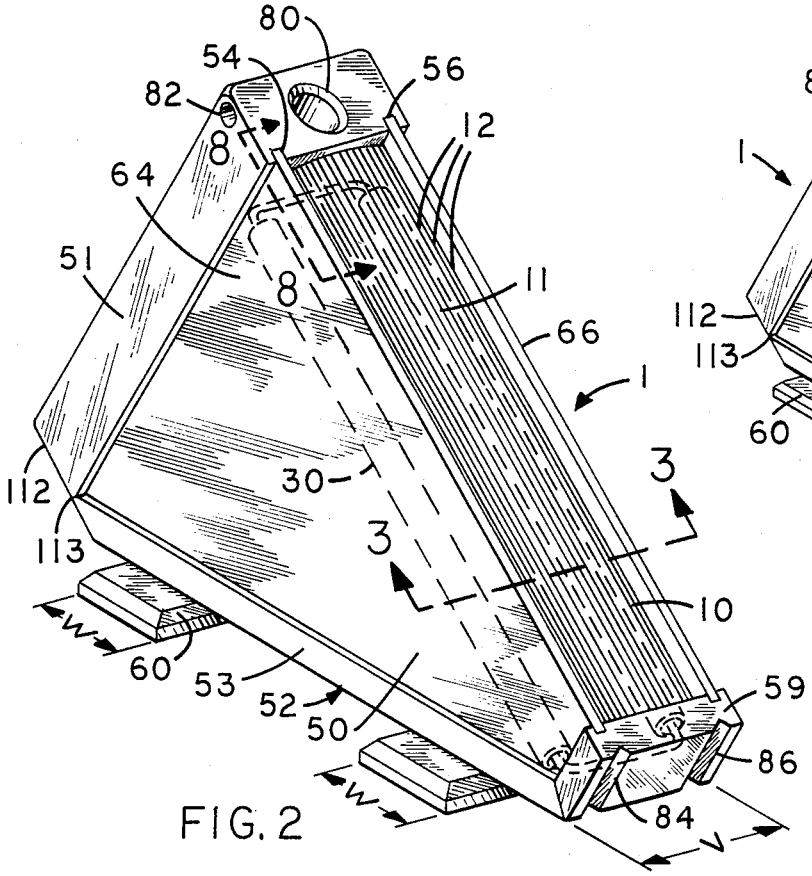
FIG. 2
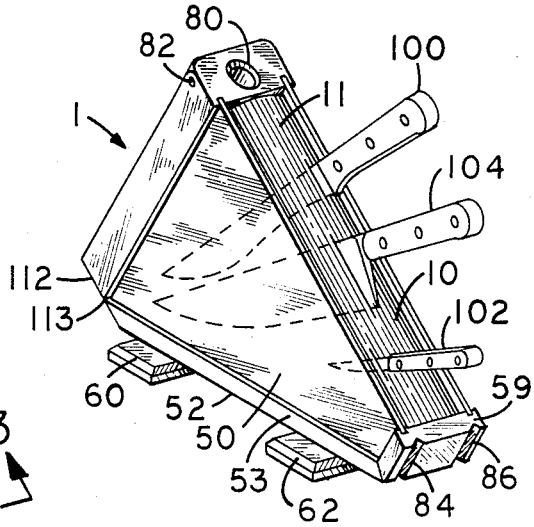
FIG. 1
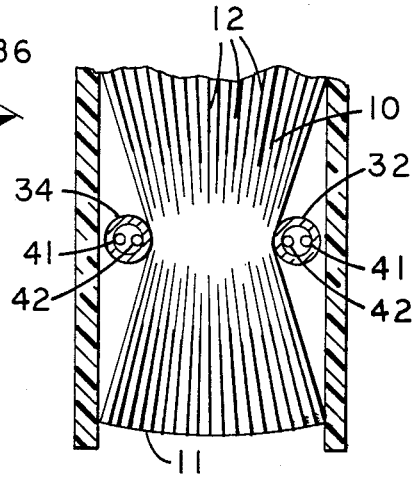
FIG. 3
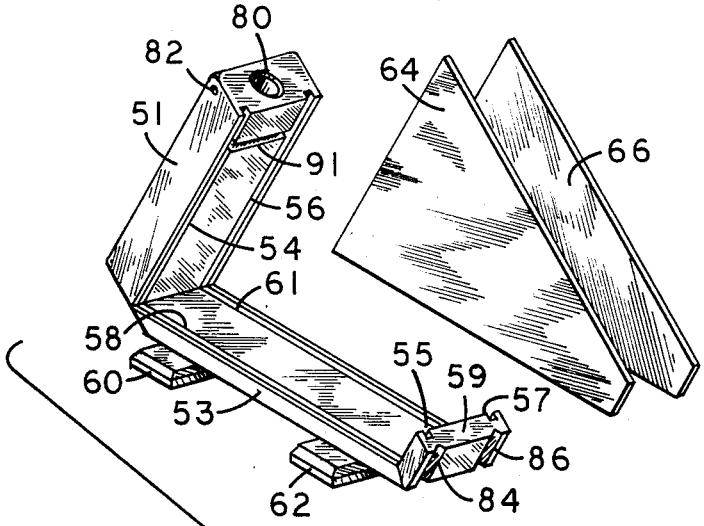
FIG. 4
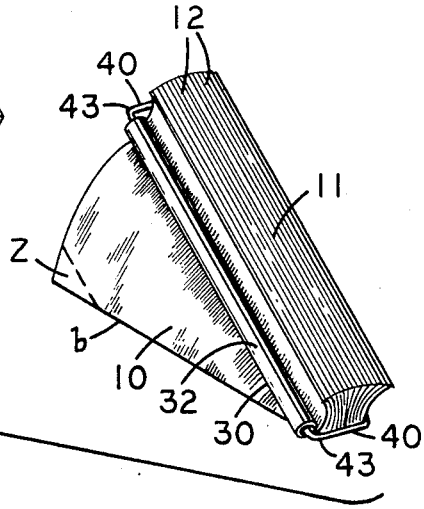

CUTLERY STORAGE APPARATUS

BACKGROUND OF THE INVENTION

This invention relates to an apparatus for holding thin objects, specifically a knife holder.

Present day knife holders can be categorized into two types according to the means employed to hold knives as either magnetic or gravitational. Magnetic types hold the blades of knives which possess sufficient magnetic permeability to be attracted to a magnetized metal bar. Gravitational types are grooved or slotted structures commonly known as racks which rely soley upon gravity to support knives and essentially do not hold the blades of knives. Both magnetic and gravitational types have limited utility. For example, a magnetized bar will not hold large blades made of inherently non-magnetic stainless steel. Conversely, large magnetic blades can modify magnetic flux in the region occupied by it to such extent that adjacent smaller knives fall from the holder. Additionally, knives are easily damaged as the cutting edges can uncontrollably slam into and scrape across the magnetized bar during attraction and retraction of the knives during use. Gravitational types on the other hand require that the blades of knives be heavier than the knife handles in order to balance themselves in an open groove or slot. This requirement is impractical and cannot be met by small, thin-bladed knives such as pairing, boning, carving, and steak knives. Consequently, the knife holding ability of gravitational types can be precarious because small knives can slide, fall, or be knocked out of the rack with little provocation.

Additionally, the two knife holder types can be further categorized into three groups according to the location in which the holder can be positioned for use. One group fits within a drawer and usually consists of a number of vertical grooves into which the knives are placed. A second type mounts on the wall and consists of a number of vertical slots for housing the knives, or consists of a magnetized metal bar to hold knives. The third type, which seems to be most popular, consists of a free-standing, slotted, wooden block which rests on a table or counter top near the area of use. In general, present day knife holders are not designed to be interchangeably mounted on a wall, placed in a drawer or set upon a counter top. A consumer must decide where to place his knife holder before making the purchase. A change of mind typically requires purchasing a new knife holder.

In addition, present day knife holders typically have either a series of slots or rectangular shaped holes of various depths. Generally, a knife has to be placed in the proper slot or hole for storage. Storing cutlery in a number of slots has several disadvantages. First, the user wastes time searching for the proper slot or opening. This is especially true with a larger knife. The person using the holder must find the proper slot which is of the proper depth so that the knife can be properly stored. In addition, many times the smaller knife is placed into a larger slot which results in a reshuffling of all the knives. Another disadvantage of slots is the inefficient use of space. The wood or plastic between the slots cannot be utilized. The present day knife holders are generally rectangularly shaped and, as a consequence, when a small knife is placed into the block, the space from the knife tip to the opposite end of the block is wasted. Still another drawback is that capacity is limited by the number of slots in the knife holder. Many times knives and a knife holder are purchased as a set. Additions to the set are not possible. The knife holder is tailored for the particular knives. As a result, when a knife becomes worn or lost and an exact replacement is unavailable, the presently owned knife holder becomes obsolete. Additionally, owners of knives who wish to acquire a holder must fit their knives to a particular holder on site by trial and error, or guess that the number and size of slots in a certain holder will accommodate.

Many present day knife holders hold knives by the shank and a portion of the cutting edge. Thus, the weight of the knife is borne by a portion of the cutting edge which tends to dull the knife. This requires, more frequent sharpening of the knife.

A further disadvantage of the present day knife holders is that there is no means for absorbing moisture which may be inadvertently left on the knife. Thus, when the knife is in the holder, it can corrode.

SUMMARY OF THE INVENTION

The cutlery storage apparatus of the present invention provides improvement regarding the above-described shortcomings of the prior art.

The apparatus includes a filler comprised of a plurality of thin sheets of flexible material, such as paper, held in side by side relation with pressure applied to the outer sheets to produce force between each sheet. Knife blades are inserted between the sheets so that the sheets grip the knife blade and hold the knife in that position.

Preferably, the compression force on the sheets is applied along a line spaced inwardly a short distance from the entry edge of the sheets. This provides the desired gripping force on the blades, while causing the sheet edges to fan apart slightly so as to make insertion of the knives smooth and easy. In a preferred approach, the compression on the sheets is provided by a spring arrangement that produces uniform pressure without introducing stress on a surrounding housing.

The cutlery storage apparatus can hold any number of knives of varying length. The knives can be from any source and can be placed randomly anywhere in the knife holder and be held effectively. Furthermore, since the cutlery storage device doe not use slots, it remains attractive even when not full. The compression force holding the knife is on the large surface of the blade and nothing engages the cutting edge of the blade. Preferably the sheets are made of paper, which advantageously absorbs water to prevent corrosion on the blades of the knives, while providing a sharpening effect during insertion and removal. The sheets and housing of the holder are shaped to allow for efficient use of space.

BRIEF DESCRIPTION OF THE DRAWINGS

FIG. 1 is a perspective view of the cutlery storage device holding several knives.

FIG. 2 is a perspective view of the cutlery storage device with the hidden pressure means shown in dashed outlines.

FIG. 3 is a revolved cross-sectional view taken along cutting plane 3—3 which passes through the pressure means in FIG. 2.

FIG. 4 is an exploded perspective view of the cutlery storage device.

DESCRIPTION OF THE PREFERRED EMBODIMENT

Figure 5:
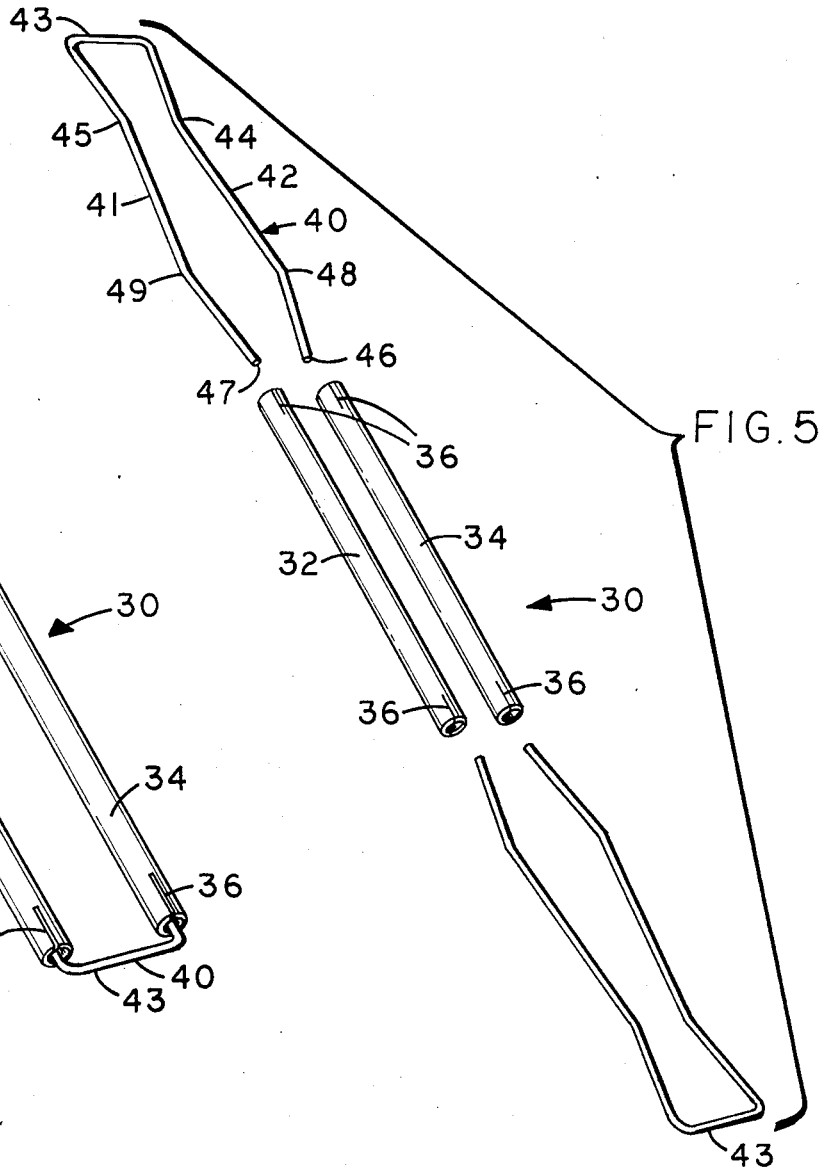
FIG. 5 is an exploded perspective view of the means for applying pressure to the sheets of the cutlery storage device.

Referring to the drawings, the cutlery storage apparatus 1 is comprised of a filler 10, and a pressure means 30 encased within a housing 50. Filler 10 is comprised of a plurality of thin, flexible sheets 12 placed in side-by-side relation, with at least one edge in common so that the edges define a substantially planar entry 11 into which the knives 100, 102, 104 are inserted. The planar entry 11 is substantially perpendicular to the large area portion of the knife blades 100, 102, 104 after they are inserted into the cutlery storage apparatus 1.

Figure 7:
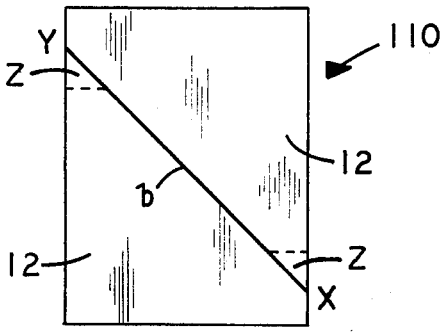
FIG. 7 is a plan view of an $8\frac{1}{2}'' \times 11''$ piece of paper cut to fit within the cutlery storage device.

In the preferred embodiment, the thin sheets of flexible material 12 are cut in a uniform shape to fit within the housing 50. Turning to FIG. 7, it can be seen that the uniform shape of the sheets 12 may be conveniently produced by cutting a standard $8\frac{1}{2}'' \times 11''$ sheet 110 of paper along a particular diagonal defined by two points, X and Y. As positioned in FIG. 7, the short sides of the $8\frac{1}{2}'' \times 11''$ sheet 110 form the edges that define the planar entry 11 of the filler 10 of FIG. 1. Point X is approximately $1\frac{1}{4}''$ from the top of the sheet 110 of paper along one of the long sides of the sheet 110, and point Y is approximately $1\frac{1}{4}''$ from the bottom edge along the opposite long side of the sheet 110. After cutting a plurality of uniform sheets 12, they are placed in side by side relation to form the filler 10. The edges formed by the diagonal cut b form the lower edge of the filler 10 as viewed in FIG. 4, while the long portion of the side edges of the sheet 110 form the upper edge of the filler hidden within the housing 50 as viewed in FIGS. 1 and 2. The filler 10 in the preferred embodiment is bound along its lower edge to keep it uniform and to keep the sheets 12 in place relative to one another.

Turning to FIG. 5, the pressure means 30 includes two resilient, generally U-shaped wire-like springs 40 and two pieces of semi-rigid plastic tubing 32. Each U-shaped wire is comprised of a base 43 and two non-straight legs 41, 42. Each leg is symmetrical to the leg oppositely disposed on the spring 40. The base 43 is slightly longer than the thickness of the filler 10. This allows the tubes to move outwardly as the resilient legs are deformed when the filler is inserted. Each leg 41 and 42 is shallowly zig-zagged or curvilinear and both legs on one spring are in the same plane. One leg 41, for example, has three segments forming a point 45 and an end point 47 which are closer to the oppositely disposed leg 42 than the other portions of the leg 41. The leg 41 also has a point 49 which is further from the leg 42 than other portions of the leg 41. The oppositely disposed leg 42 is symmetrical to leg 41, points 44 and 46 being closest to leg 41 and point 48 being most distal from leg 41. The second U-shaped wire-like spring 40 is identical to the one just described.

The length of each tube 32 is essentially equal to the length of one leg 41 or 42 of the U-shaped wire-like spring 40. In a working embodiment of the invention, the tubes have an approximate inside diameter of $\frac{1}{4}''$. Each tube end has a pair of oppositely disposed slits 36 extending parallel to the tube axis.

Figure 6:
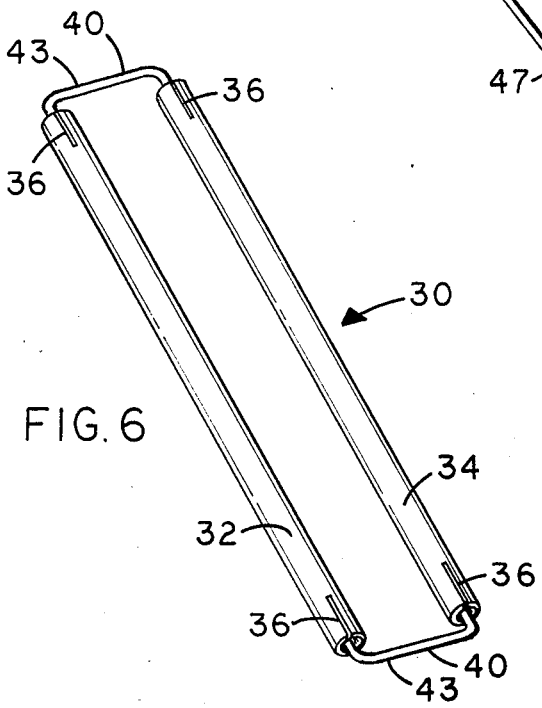
FIG. 6 is a perspective view of an assembled pressure means.

To assemble the pressure means 30 of FIG. 6, one leg 41 of one U-shaped wire-like spring 40 is inserted into one tube 32, while the other leg 42 is inserted into the other tube 34. The legs of the other U-shaped wire-like spring 40 are then similarly inserted into the opposite ends of the two pieces of tubing. Tube 32 is identical to tube 34.

Placing tubes 32 over the legs 41 and 42 of the two U-shaped wire-like springs 40 straightens the legs 41 and 42 slightly and legs 41 and 42 overlap at points where the zig-zagged portions of both springs 40 crossover. These crossover points, not shown, and the curvilinear form of the springs 40 can be considered as trusses acting to stiffen semi-rigid tubes 32 against bending forces resulting from frictional drag between contacting surfaces of filler 10 and tubes 32 during filler insertion or removal. When the pressure means 30 is not around a filler 10, each tube 32 is in static equilibrium with, for example, forces acting at points 45 and 47 acting toward the opposite tube and a force acting at point 49 acting away from the opposite tube. Each leg in each tube produces similar forces. When the filler is inserted between the tubes and legs, the tubes are spread against the resiliency of its spring legs. The outward deflection of each resilient leg 41 and 42 produces a force acting through tubes 32 toward the filler as each leg tries to regain its original shape. The greater the deflection of springs 40, the greater the inwardly acting force. The inward spring forces are greatest at points 44, 45, 46 and 47 of each spring and the tubes 32 disperse these forces to produce a substantially uniform pressure along the surface of the tube 32 contacting the filler 10. Each pair of oppositely disposed slits 36 on the ends of each tube 32 allow the end points 46, 47 of each U-shaped wire 43 to distribute a greater inward force on the ends of the plastic tubes 32.

The base 43 of the spring 40 is greater in length than the thickness of the filler 10 to allow adequate space for the resilient legs, 41 and 42, to deform or deflect. When nothing is inserted between the tubes 32 of the pressure means, legs 41 and 42 can be thought of as, on the average, occupying the space around the axis of each tube. As items are inserted, namely the filler 10 and knives, the tubes 32 move out and away from each other thereby further straightening the legs, 41 and 42, and further deflecting the springs 40. As knives are inserted into filler 10, the semi-rigid tubes 32 deflect outwardly against the inwardly acting forces of each spring proximate the knives in a suitably independent manner. These forces are sufficiently localized or isolated so as to not release the holding forces acting inwardly on previously inserted knives. To be most effective, the items between the tubes should deflect the springs beyond the equilibrium position but not more than the distance equal to the length of the base less two wall thicknesses of the tubes of the pressure means 30.

Referring to FIGS. 1, 2, and 4, the housing 50 of the holder comprises a frame 52 and two side walls 64 and 66. The frame includes an upper member 51, a lower member 53, and an upturned end 59. Passing through the length of the upper member 51 is a circular opening 80 approximately $\frac{5}{8}''$ in diameter. Proximate the upper end of the upper member 51 are two small openings 82 (one is not shown) which lie along an axis perpendicular to the axis of opening 80. Also in the upper member 51 are two grooves 54 and 56. The grooves 54 and 56 are located on the inside surface proximate the edge of upper member 51 and run the length of the upper member 51.

The lower member 53 includes the upturned end 59, and end 112 which is formed by a mitre cut through the point of intersection 113 of lower member 53 and upper member 51. Ends 59 and 112 are disposed parallel to members 51 and entry edge 11, respectively. Ends 59 and 112 are ideally of identical proportions and positioned equidistant from the two small openings 82 (one not shown). Lower member 53 and the upturned end 59 also have grooves 55, 57 and 58, 61 located on the inside surface proximate the edge of lower member 53 and the upturned end 59, respectively. Attached to the bottom of the lower member are two rectangular rotatable bases 60 and 62. The width of each base, 60 and 62, is depicted by a dimension W. The width of the upper member 51 and lower member 53 is depicted by a dimension V. The dimension W is equal to or less than a dimension V. The bases, 60 and 62 are shown in FIGS. 1, 2, and 4 in an outward position to provide a stable base for a holder in an upright, free-standing position. Bases 60 and 62 can be rotated to an inward position approximately 90° from the outward position. With the basess 60 and 62 in the inward position, the maximum width of the holder is the dimension V of the frame members 51 and 53. In this mode, the holder can be laid on its side within a drawer or conveniently mounted on a flat surface in a horizontal or vertical orientation without intereference of the bases 60 amnd 62.

The side walls 64, 66 are essentially triangularly shaped as shown in FIG. 4. More accurately, the shape of the side walls 64 and 66 is a trapezoid with the side of the trapezoid which forms the entry edge 11 being perpendicular to both bases of the trapezoid. The side walls 64, 66 are dimensioned to fit within the corresponding grooves 54, 58, 55, and 56, 61, 57 in the upper frame element 51, the lower member 53 and upturned end 59, respectively. It should be noted that if the housing is molded in two halves about a center line, which parallels the length of both frame members 51 and 53, grooves 54, 58, 55, 56, 61, 57 are not necessary.

In operation, the pressure means 30 is positioned around the filler 10 approximately 1¼" from and parallel to the planar entry 11. The pressure means 30 produces a pressure normal to the outer sheets 12 of the filler 10 along the line where it is positioned which in turn produces a localized compression force between the sheets 12 to hold the blades of the knives 100, 102, 104. The pressure is sufficient to hold a knife in the orientation selected, which as seen in FIG. 1, is about 45° with the paper sheets vertically oriented. With the primary gripping force being applied close to the entry edge 11 of the stack, even the shorter blade of the knife 102 is adequately gripped.

Along the line where the pressure means 30 is positioned, the sheets 12 are more compressed than along the entry edge 11. As FIG. 3 illustrates, the compression force causes the sheets 12 to flare or fan outwardly from the line where the pressure means 30 is located to the entry edge 11 of the sheets 12. The outward flare of the sheets 12 proximate the entry 11 or more open sheet relation at the entry facilitates insertion of the knives 100, 102, 104. The lessened pressure between the sheets 12 provides space for lateral deflection of sheets 12 upon impact between the knives 100, 102, 104 and edges of the sheets 12 along the entry edge 11 thereby preventing tatering of the edges of the sheets 12 of the entry surface 11 during insertion of the knives.

Figure 8:
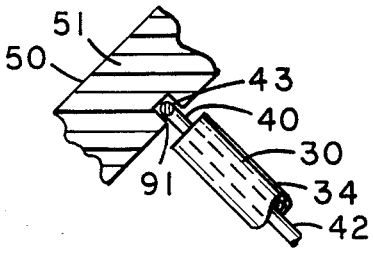
FIG. 8 is a cross-sectional view taken along cutting plane 8—8 which passes through the pressure means in FIG. 2.

With reference to FIG. 8, the upper frame element 51 and upturned end 59 each have a groove 91 which is perpendicular to the length of the frame elements 51 and end 59, respectively. Groove 91, located in upturned end 59, is not shown. The grooves 91 hold the bases 43 of each U-shaped wire-like spring 40 of the pressure means 30 in position in an assembled holder 1.

Referring to FIG. 3, it is easily seen that the pressure means 30 applies the compression force to the filler 10 independent of the housing 50 since a space exists between housing 50 and the pressure means 30 which allows the filler 10 to expand without contacting the side walls 64, 66. As the wire-like springs 40 are flexed further outward, the increased deformation produces a greater compression force. The added space allows for the greater flexing and increased force needed to hold the knives. If the tubes 32 of the pressure means 30 are deflected too far bulging results, which threatens the independence of the pressure means from the housing 50. If the pressure means bulge to the point where the tubes contact the housing, the housing begins applying part of the compression force.

Similarly, if no space between the pressure means 30 and the side walls 64, 66 were provided, the side walls 64, 66 would produce part of the compression force to hold the knives when the pressure means 30 contacted the side walls 64, 66. This could be done but would be disadvantageous, since the material used for the housing 50 is not as resilient as the U-shaped springs and the housing 50 would soon deform. For example, a wooden or plastic housing 50 could warp and relax as a result of the localized force on the housing 50.

The round surface of the tubes 32 of an assembled pressure means 30 facilitate the insertion of the filler 10 in the housing 50. The round surface serves to guide the filler past the tubes 32 without damaging the sheets 12 of filler 10. The initial contact of the filler 10 with each tube 32 occurs between a plane tangent to the tube along the line on the tube 32 closest to the other tube 32 in an assembled pressure means 30 and a parallel plane which includes the axis of the tube 32. As the filler 10 is further inserted in between the pressure means 30 the rounded edge gradually wedges or necks down the filler 10 to guide it past the pressure means.

The filler 10 is easily replaceable. To increase the life of a filler 10 it can be made symmetrical by cutting each sheet 12 of the filler 10 along line Z. The symmetrical filler 10 can then be withdrawn from the housing 50, and the filler 10 can be turned 180°, and reinserted into the housing 50 to make what was formerly the upper edge hidden within housing 50 the new entry edge 11. By making the filler 10 symmetrical the life of the filler 10 can be extended without affecting the capacity of the holder. Each sheet 12 in the filler 10 may also be impregnated with a matrix of tough fibers (not shown) to enhance the fillers' 10 durability.

To mount the cutlery storage device 1 to a surface, the bases 60 and 62 are rotated into the inward position so the bases do not interfere with the mounting. One screw is then placed in the desired surface and positioned so the head of the screw will engage with one of two parallel grooves 84 or 86 external to the housing 50 and in the upturned end 59. Another screw is similarly positioned to engage either parallel groove (not shown) in the end 112 of the lower frame element 53 opposite the upturned end 59. The holder 1 is then engaged snugly with the heads of the two screws and third screw is passed through opening 82 and anchored to the surface. The large opening 80 stores a circular knife sharpener in any position the cutlery storage device is mounted.

Referring to FIG. 1, the knives 100, 102, 104 can be placed in most any position in the holder 1. Furthermore, the distance between the tips of knives 100, 102, 104 shown in dashed lines in FIG. 1 and the lower frame element 53 are minimized with proper positioning of the knives 100, 102, 104. For the most efficient use of space, the smaller knives can be placed closer to the upturned end 59 of the lower frame element 53 while the larger knives can be positioned more toward the upper frame element 51.

We claim:

1. An apparatus for holding thin objects comprising:

a filler including a plurality of thin flexible sheets placed in side by side relation;

pressure means applying a force to the outer sheets of said filler, said pressure means producing a compression force between the individual sheets of said filler for gripping thin objects;

a means for causing the sheets of said filler proximate one edge of said filler to flare outward;

a housing shaped to receive said filler, said pressure means applying the compression force independent of said housing; and a pair of movable rectangular bases on the housing capable of an inward and an outward position, said bases being wider than the thickness of the housing when in an outward position, said bases being thinner than the thickness of said housing when in an inward position.

2. A holder comprised of:

a stack of pliable sheets;

a pair of resilient U-shaped metal springs each further comprised of:

a base having a dimension slightly larger than the thickness of said stack; and a pair of curvilinear legs, shaped to produce a force toward the oppositely disposed leg upon outward deformation; and a pair of semi-rigid tubes, said tubes equal in length to the length of one of said curvilinear legs, one of said legs of the first spring being inserted into the first of said tubes with the other leg of the first spring being inserted into the second tube, one leg of the second spring being inserted into the opposite end of the first tube with the other leg of the second spring being inserted into the opposite end of the second tube, said tubes having an inside diameter to allow movement of the tubes relative to the legs within the tube, said resilient springs and tubes being placed around said stack such that said plastic tubes contact the outer sheets of said stack to produce a compression force between said sheets near one edge of said sheets.

3. The holder of claim 2 is located close to but spaced from one edge of the stack so as to cause the sheets in the area where the tubes are placed to be more closely packed than the sheets along said stack edge.

4. The holder of claim 2 further comprised of a housing shaped to receive said stack, tubes and springs, said housing having a retaining means to hold said assembled tubes and springs in position about said stack in a manner such that said compression force between said sheets does not rest against said housing.

5. The holder of claim 2 wherein said tubes have slits proximate each end of each tube to distribute compressive forces.

6. A knife holder comprising a stack of paper sheets for receiving knife blades between the sheets, a housing enclosing the sheets with one edge of the stack being exposed through an opening in the housing so that knife blades may be inserted and withdrawn through that edge of the stack, structure within the housing for compressing said stack so that the sheets grip the knife blade with sufficient force to hold the knive even when the sheets are vertically oriented and the knife extends with a substantial horizontal component, said compression structure being arranged to apply the gripping force in an area spaced a short distance from the knife entry edge of the stack so that the sheets are more tightly compressed in that area then at the entry edge so as to facilitate insertion of the knife blade into said stack while yet having said tightly compressed area located so that it will be reached by even a short knife blade.

7. The knife holder of claim 6 wherein said short distance is between one-half inch and three inches from said entry edge.

8. The knife holder of claim 6 wherein said compressing structure is arranged to apply the compression force independent of said housing.

9. The knife holder of claim 8 wherein said housing includes means for keeping said compressing structure in a stationary position within said housing.

* * * * *